US008325965B2

(12) United States Patent
Blackmon et al.

(10) Patent No.: US 8,325,965 B2
(45) Date of Patent: Dec. 4, 2012

(54) AUDIO SPEAKER HAVING A TWEETER CAPABLE OF CONTINUOUS ROTATION

(75) Inventors: Leif Blackmon, Medfield, MA (US); Brian Cox, Las Vegas, NV (US); Tim Higgins, Allston, MA (US)

(73) Assignee: Boston Acoustics, Inc., Woburn, MA (US)

( * ) Notice: Subject to any disclaimer, the term of this patent is extended or adjusted under 35 U.S.C. 154(b) by 1421 days.

(21) Appl. No.: 11/649,716

(22) Filed: Jan. 4, 2007

(65) Prior Publication Data

US 2007/0189557 A1 Aug. 16, 2007

Related U.S. Application Data

(60) Provisional application No. 60/756,158, filed on Jan. 4, 2006.

(51) Int. Cl.
*H04R 1/02* (2006.01)

(52) U.S. Cl. ..... 381/386; 381/387; 381/389; 381/394; 381/395

(58) Field of Classification Search ..... 381/387, 381/389, 394, 395, 386
See application file for complete search history.

(56) References Cited

U.S. PATENT DOCUMENTS 4,165,797 A 8/1979 Spetalnik
4,365,114 A 12/1982 Soma
4,441,577 A 4/1984 Kurihara
4,553,630 A 11/1985 Ando
4,554,414 A 11/1985 House
4,811,406 A 3/1989 Kawachi
4,875,233 A * 10/1989 Derhaag et al. ..... 379/430
5,148,490 A 9/1992 Draffen
5,181,253 A 1/1993 Jordan
5,512,714 A 4/1996 Fenton
5,568,562 A * 10/1996 Huang ..... 381/186
5,629,501 A 5/1997 Fenton
5,635,686 A 6/1997 Fenton
5,751,821 A 5/1998 Smith
5,859,917 A * 1/1999 Silber et al. ..... 381/389
6,002,780 A 12/1999 Espiritu
6,026,927 A 2/2000 Burdett et al.

(Continued)

FOREIGN PATENT DOCUMENTS

JP 59-48193 3/1984

(Continued)

*Primary Examiner* — Yuwen Pan
*Assistant Examiner* — Matthew Eason
(74) *Attorney, Agent, or Firm* — Peter A. Nieves; Sheehan Phinney Bass + Green PA

(57) ABSTRACT

An audio speaker contains a tweeter capable of continuous rotation, where the audio speaker contains the tweeter and an axis mount assembly. The tweeter is removably connected to the axis mount assembly. The audio speaker also contains a first connection member capable of maintaining electrical communication with the axis mount assembly throughout continuous rotation of the axis mount assembly. The axis mount assembly contains a terminal plate connected to a bottom portion of the tweeter, where the terminal plate maintains electrical communication with the tweeter. The axis mount assembly also contains an axis mount faceplate capable of receiving the terminal plate and tweeter within an indented portion of a top portion of the axis mount faceplate. The axis mount assembly further contains an axis mount spacer and a second connection member that maintains electrical communication with the first connection member throughout continuous rotation of the axis mount assembly.

22 Claims, 13 Drawing Sheets

U.S. PATENT DOCUMENTS

| | | | | |
|---|---|---|---|---|
| 6,070,694 | A | 6/2000 | Burdett et al. | |
| 6,101,262 | A | 8/2000 | Haase et al. | |
| 6,282,297 | B1 | 8/2001 | Lin | |
| 6,356,640 | B1 | 3/2002 | Lin | |
| 6,374,942 | B1 | 4/2002 | Huggins | |
| 6,683,963 | B2 | 1/2004 | Sterns et al. | |
| 6,724,907 | B1 | 4/2004 | Chan | |
| 6,792,125 | B1 | 9/2004 | David et al. | |
| 6,876,752 | B1 | 4/2005 | Guenther | |
| 7,121,756 | B2 | 10/2006 | Wright et al. | |
| 7,801,323 | B2 * | 9/2010 | Shain | 381/386 |
| 2002/0081980 | A1 | 6/2002 | Reus | |
| 2003/0044039 | A1 | 3/2003 | Sterns et al. | |
| 2003/0142844 | A1 | 7/2003 | Rivera | |
| 2005/0123156 | A1 | 6/2005 | Wright et al. | |
| 2005/0265566 | A1 | 12/2005 | Suzuki et al. | |
| 2006/0023903 | A1 | 2/2006 | Hayashi et al. | |

FOREIGN PATENT DOCUMENTS

| | | | |
|---|---|---|---|
| JP | 62013197 | A * | 1/1987 |
| JP | 63-203365 | | 8/1988 |
| JP | 06-269076 | | 3/1993 |
| JP | 07-098831 | | 4/1995 |
| JP | 07-287941 | | 10/1995 |
| JP | 07-300853 | | 11/1995 |
| JP | 2001-147940 | | 5/2001 |
| JP | 2001-157291 | | 6/2001 |
| JP | 2005-340924 | | 12/2005 |
| WO | 02-19761 | A3 | 3/2002 |
| WO | 2004-030408 | A1 | 4/2004 |

* cited by examiner

AUDIO SPEAKER HAVING A TWEETER CAPABLE OF CONTINUOUS ROTATION

CROSS-REFERENCE TO RELATED APPLICATIONS

This application claims priority to U.S. Provisional Application entitled, "AUDIO SPEAKER HAVING A ROTATABLE TWEETER," having Ser. No. 60/756,158, filed Jan. 4, 2006, which is entirely incorporated herein by reference.

FIELD OF THE INVENTION

The present invention is generally related to audio speakers, and more particularly is related to an audio speaker having a tweeter that is capable of continuous rotation.

BACKGROUND OF THE INVENTION

Use of audio speakers within an enclosed environment is limited by the direction of speaker projection. Specifically, to optimize sound projection, audio speakers are typically directed toward a specific location within the enclosed environment where a listener, or listeners, will be located. To direct the audio speakers, entire audio speakers are typically placed in an arrangement so that speaker projection is directed to the listener. As an example, in a room, speaker cabinets, having audio speakers therein, may be angled to face where a listener would be located.

Unfortunately, in certain enclosed environments locations for placing or installing audio speakers are predefined. As an example, openings for receiving audio speakers in an automobile are typically predefined by the manufacturer of the automobile. During finishing of the automobile, audio speakers are inserted into the predefined openings, resulting in the sound typically being projected in a direction that is not toward a passenger or driver of the automobile. As is well known, typical locations for automobile speakers are at the bottom of a door, on a dashboard, and in the back of the automobile, however, the audio speakers typically do not face a passenger or driver of the automobile. Instead, passengers and drivers of automobiles receive audio sound after sound waves have bounced about the interior of the automobile.

Thus, a heretofore unaddressed need exists in the industry to address the aforementioned deficiencies and inadequacies.

SUMMARY OF THE INVENTION

Embodiments of the present invention provide an audio speaker having a tweeter capable of continuous rotation. Briefly described, in architecture, one embodiment of the audio speaker, among others, can be implemented as follows. The audio speaker contains a tweeter having a top portion and a bottom portion, and an axis mount assembly, where the tweeter is removably connected to the axis mount assembly. The audio speaker also contains a first connection member, capable of maintaining electrical communication with the axis mount assembly throughout continuous rotation of the axis mount assembly within the audio speaker.

The axis mount assembly contains a terminal plate capable of connecting to the bottom portion of the tweeter, wherein the terminal plate maintains electrical communication with the tweeter. The axis mount assembly also contains an axis mount face plate having a top portion and a bottom portion, wherein the axis mount face plate is capable of receiving the terminal plate and tweeter within an indented portion of the top portion of the axis mount face plate. The axis mount assembly further contains an axis mount spacer located beneath the axis mount face plate and a second connection member that maintains electrical communication with the first connection member throughout continuous rotation of the axis mount assembly within the audio speaker.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

It should be noted that while the present description provides the example of the audio speaker having a rotatable tweeter aiming system (also referred to herein as a tweeter assembly) being located within an automobile, the location for use of the audio speaker having the rotatable tweeter is not limited to automobiles, but instead, may be use in any environment that would benefit from having a tweeter that can be directed by rotation to optimize sound projection of the audio speaker. As an example, the audio speaker may be wall or ceiling mounted within a room.

Figure 1A:
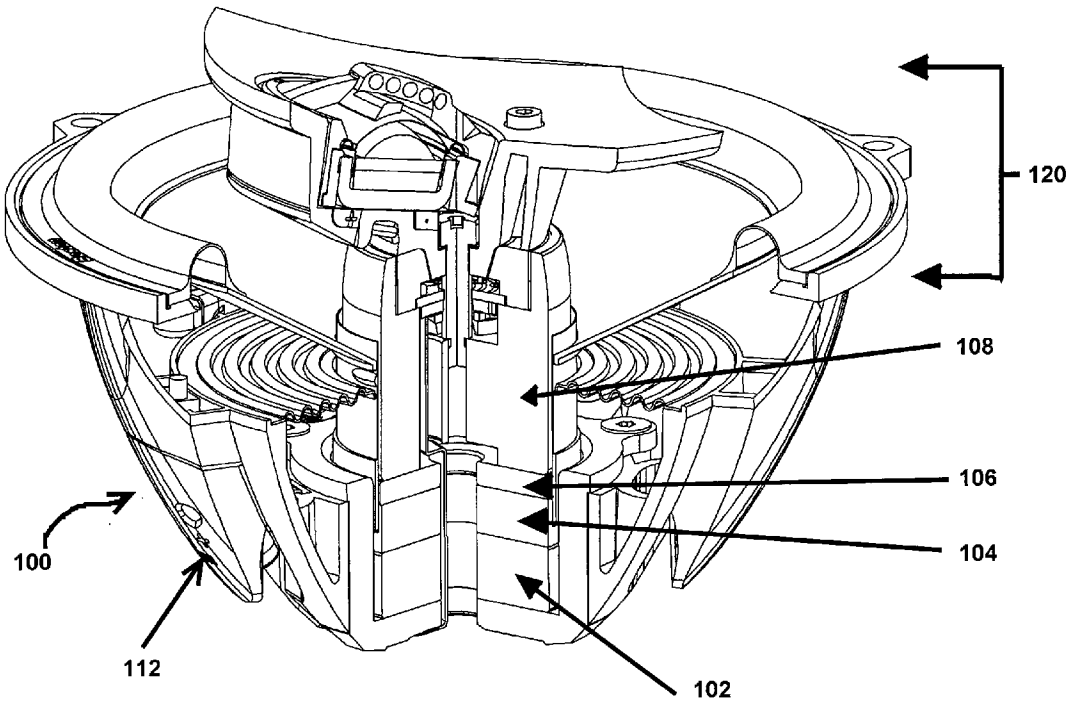
FIG. 1A is a cross-sectional view of the present audio speaker, where a tweeter assembly is rotatably connected to the audio speaker.
Figure 1B:
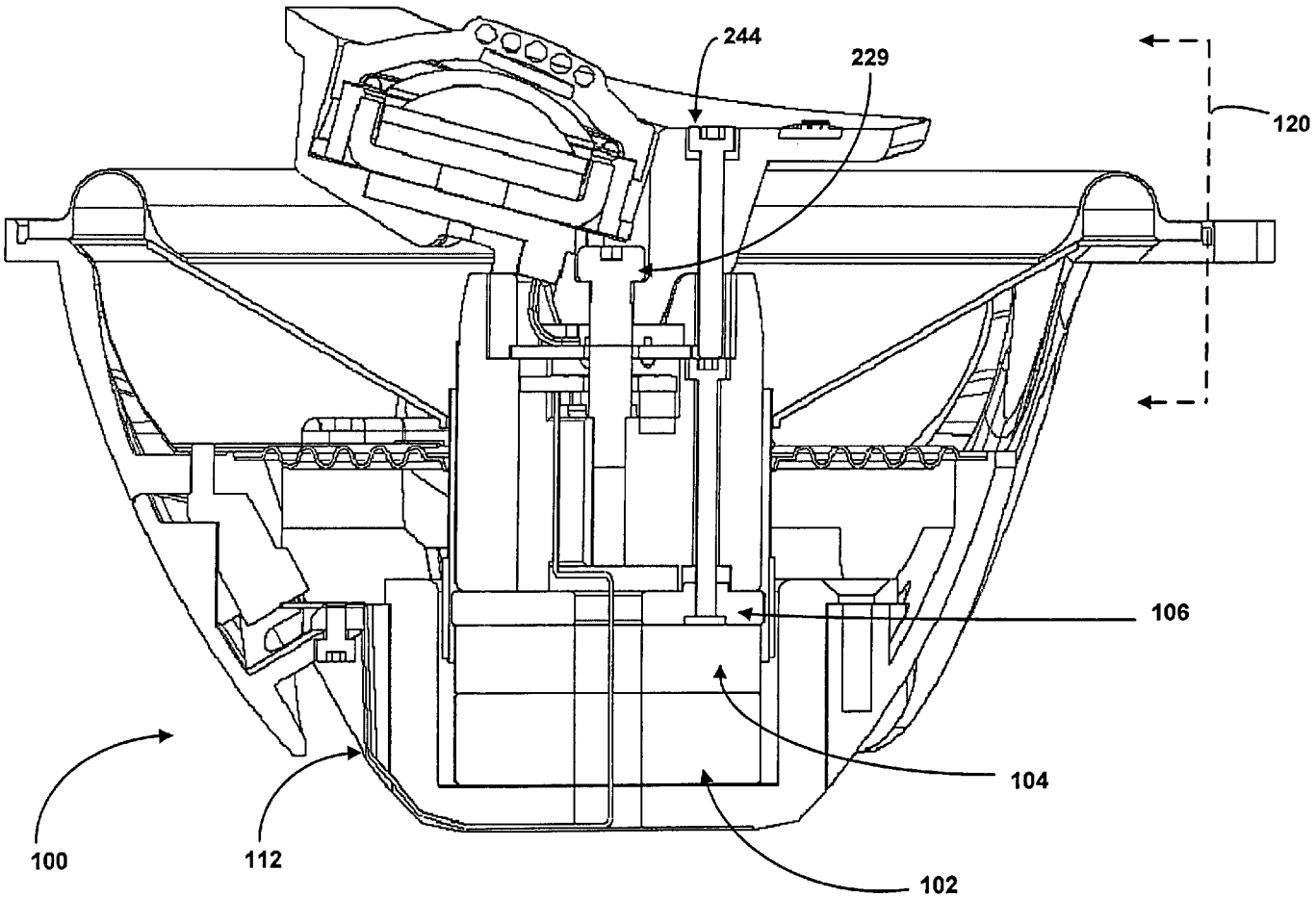
FIG. 1B is a cross-sectional line drawing illustrating the audio speaker of FIG. 1A.

FIG. 1A is a cross-sectional view of the present audio speaker 100, where a tweeter assembly 120 is rotatably connected to the audio speaker 100. FIG. 1B is a cross-sectional line drawing illustrating the audio speaker 100 of FIG. 1A.

Referring to FIG. 1A and FIG. 1B, the audio speaker 100 contains a back plate 102, an electro-magnet 104, a top plate 106, a phase plug 108 (i.e., base), and a tweeter assembly 120. The electro-magnet 104 is supported between the back plate 102 and the top plate 106.

As is known by those having ordinary skill in the art, the phase plug 108 is a fixed waveguide. The phase plug 108 has an indented central portion for receiving the tweeter assembly 120. Since the combination of a back plate 102, electro-magnet 104, top plate 106, and phase plug 108 is known, further description of functions provided by the same is not provided herein, except to mention that the combination provides the basic functionality of a woofer. Connections within the tweeter assembly 120 and interaction with the audio speaker 100, so as to provide the capability of a tweeter and axis mount assembly rotating more that 360 degrees, is further defined herein.

Figure 1C:
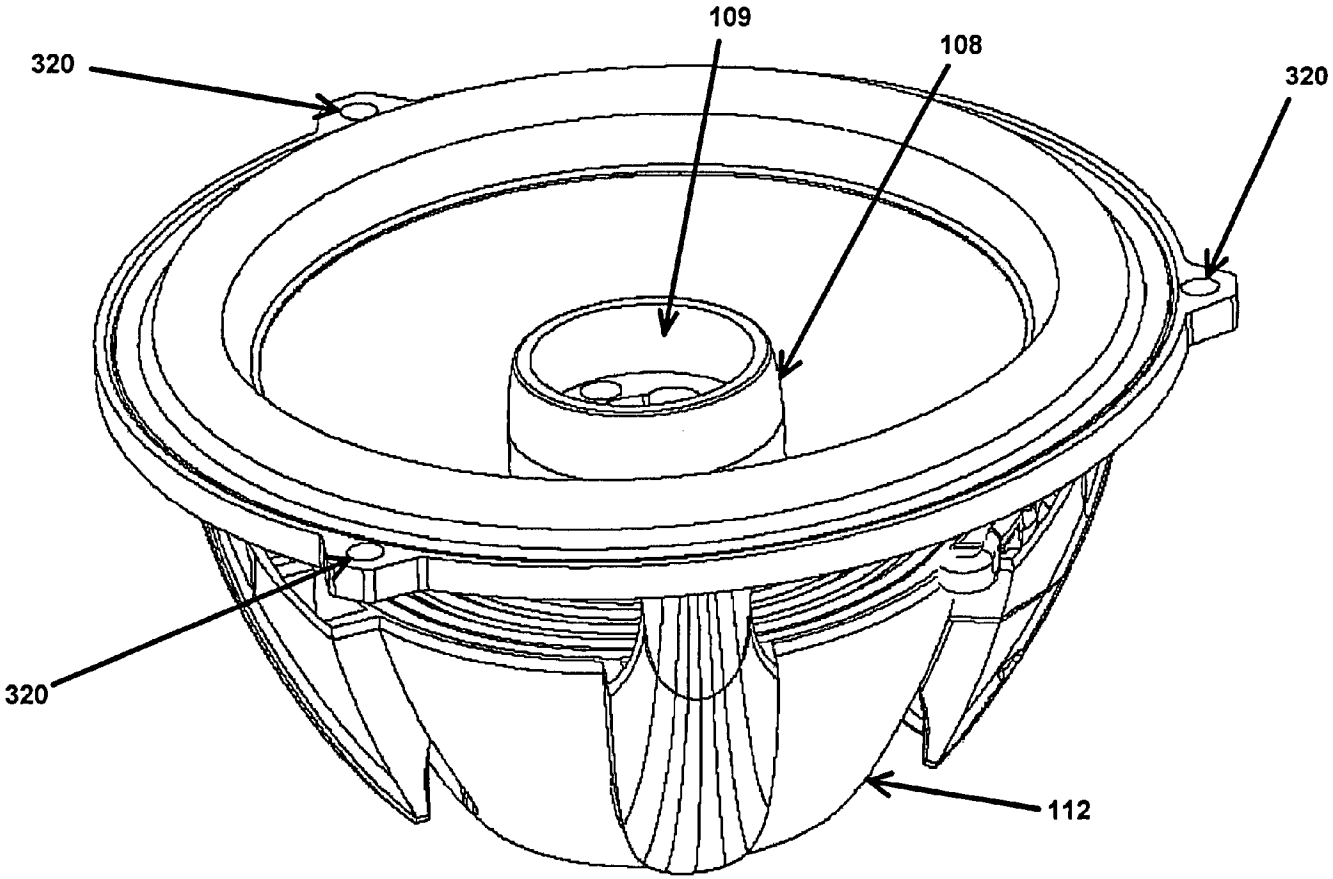
FIG. 1C further illustrates the audio speaker of FIG. 1A and FIG. 1B, without the tweeter assembly connected.

The audio speaker 100 also contains a frame 112. Optionally, the phase plug 108 and frame 112 may serve as heat sinks for the woofer. FIG. 1C further illustrates the audio speaker 100 of FIG. 1A and FIG. 1B, without the tweeter assembly 120 connected, also referred to herein as the woofer. FIG. 1C better illustrates the indented central portion 109 of the phase plug 108. FIG. 1C also illustrates receiving holes 320, which are described in more detail hereinbelow.

Figure 2:
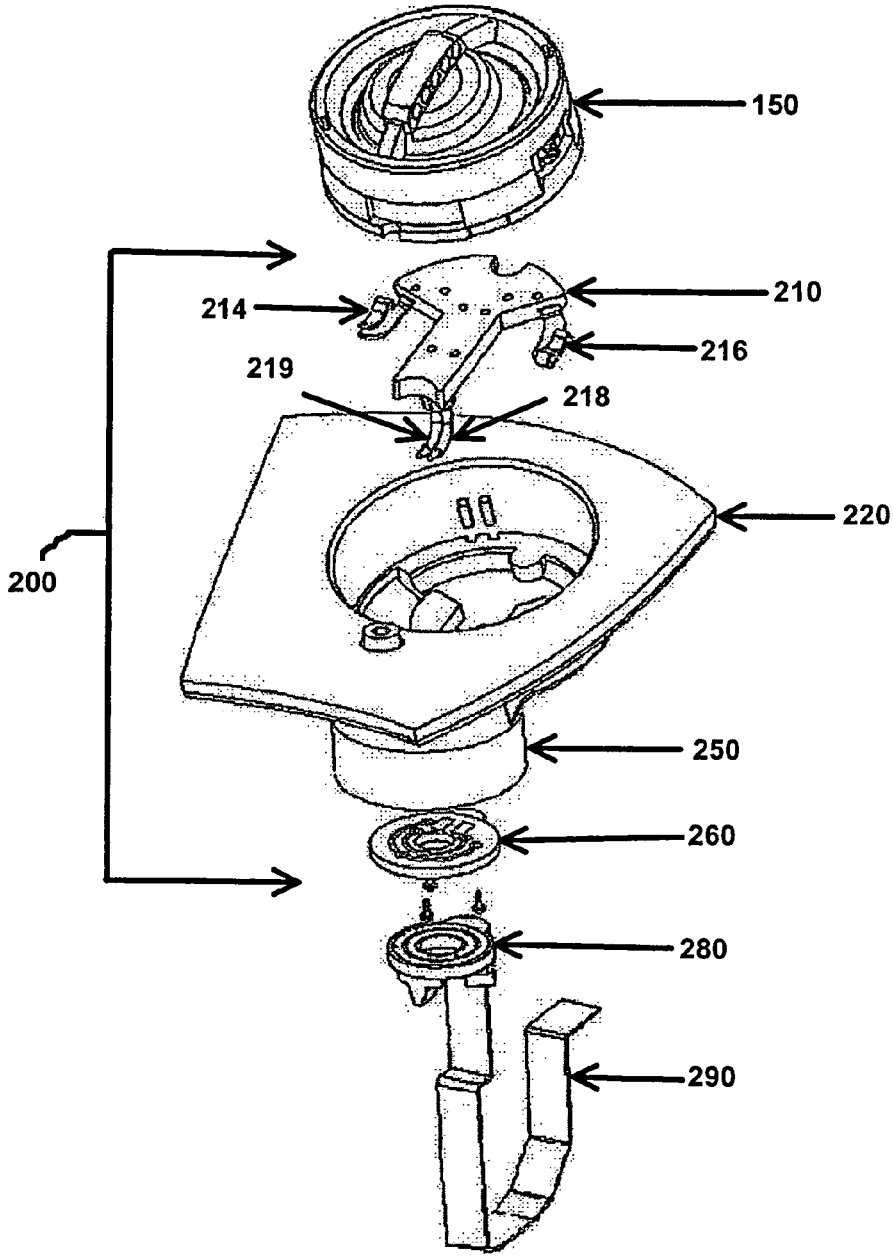
FIG. 2 is a sectional schematic view of the tweeter assembly, located internal to the audio speaker of FIG. 1A.

FIG. 2 is a sectional schematic view of the tweeter assembly 120, located internal to the audio speaker 100, which is associated with providing the tweeter 150 with the capability of rotating over 360 degrees. As is shown by FIG. 2, the tweeter assembly 120 contains a tweeter 150, an axis mount assembly 200, a female printed circuit board (PCB) 280, and a conductive strip 290. As is explained in further detail hereinbelow, the tweeter 150 is connected to the axis mount assembly 200, thereby providing continuous rotational capability of the tweeter 150. Specifically, as is explained in further detail hereinbelow, connection of the tweeter 150 to the axis mount assembly 200 provides a stationary connection between the tweeter 150 and the axis mount assembly 200. Since the axis mount assembly 200 is capable of rotating over 360 degrees within the audio speaker 100, the tweeter 150 is provided with the capability of rotating over 360 degrees within the audio speaker 100.

Figure 3:
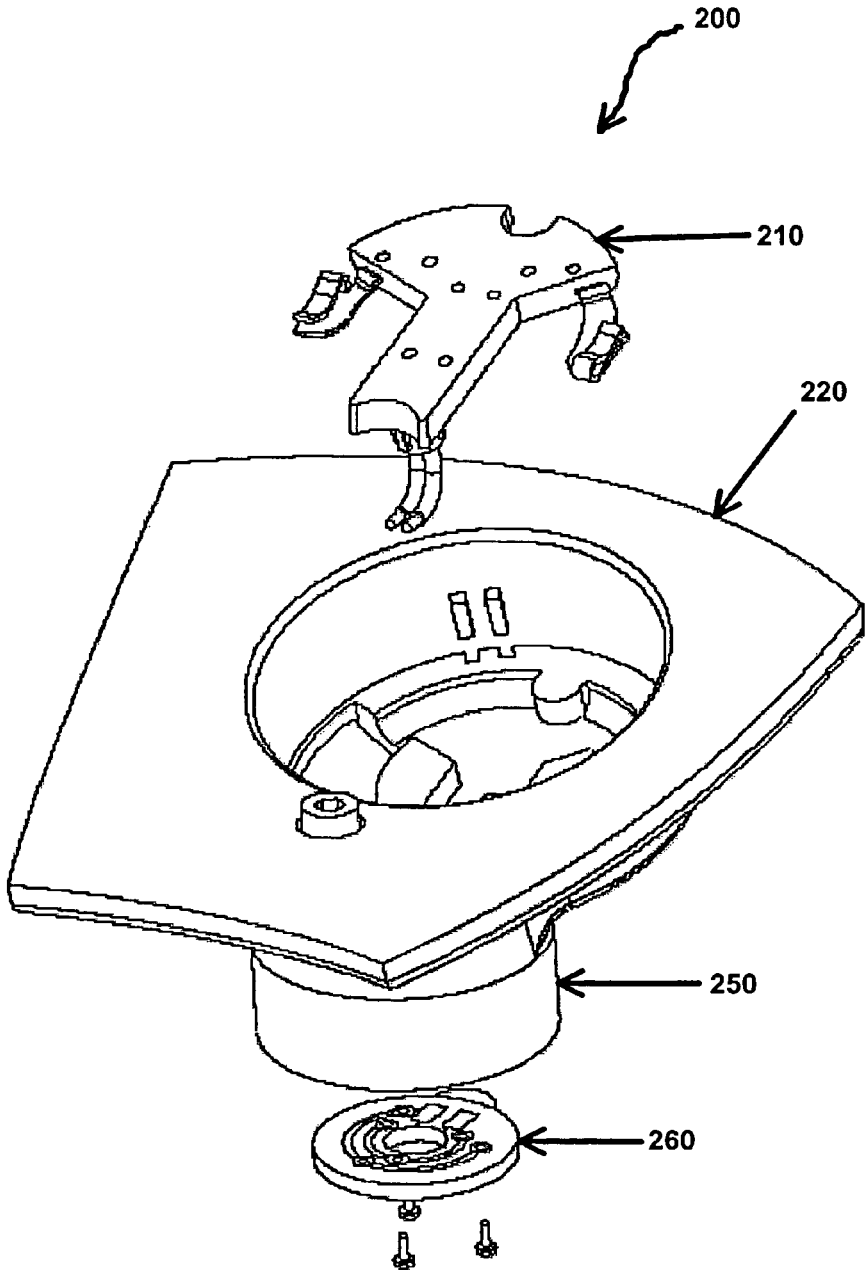
FIG. 3 further illustrates the axis mount assembly of FIG. 2.

The axis mount assembly 200 contains a terminal plate 210, an axis mount faceplate 220, an axis mount spacer 250, and a male PCB 260. Each portion of the axis mount assembly 200 is described in detail herein. In addition, FIG. 3 further illustrates the axis mount assembly 200 of FIG. 2.

Figure 4:
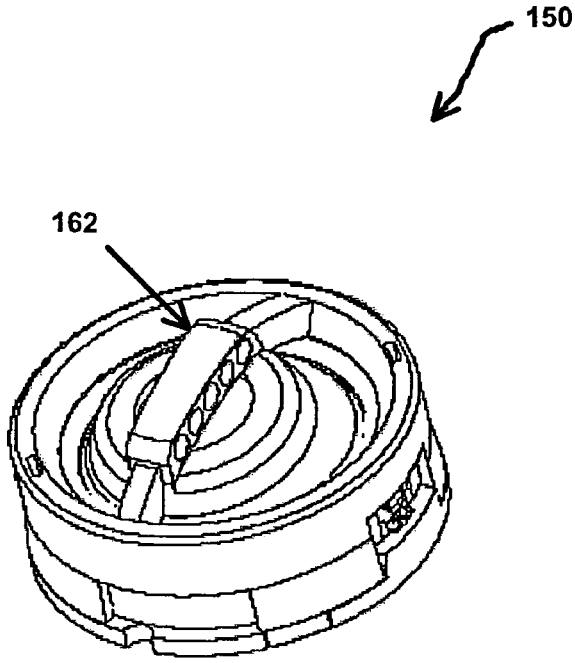
FIG. 4 is a schematic diagram further illustrating the tweeter of FIG. 2.
Figure 5A:
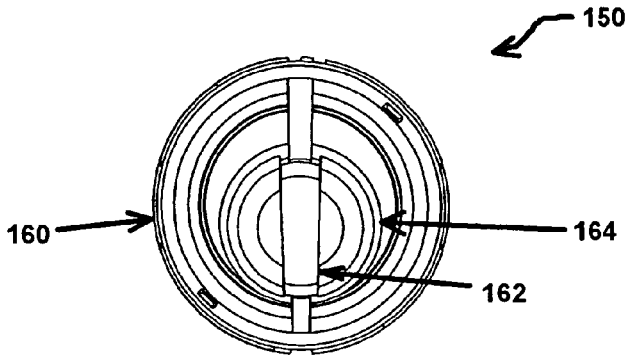
FIG. 5A is a top view of the tweeter of FIG. 4.
Figure 5B:
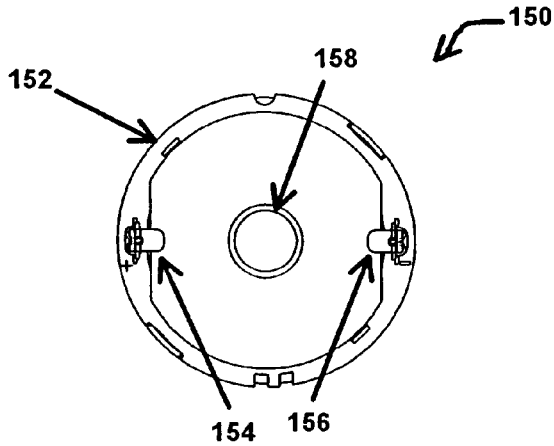
FIG. 5B is a bottom view of the tweeter of FIG. 4.

FIG. 4 is a schematic diagram further illustrating the tweeter 150 of FIG. 2. In addition, FIG. 5A is a top view of the tweeter 150 of FIG. 4 and FIG. 5B is a bottom view of the tweeter 150 of FIG. 4. Referring to FIG. 4, FIG. 5A, and FIG. 5B, a bottom portion 152 of the tweeter 150 contains a first conductive leg 154, a second conductive leg 156, and a back opening 158, where the back opening 158 is for receiving a bolt (not shown). The first conductive leg 154 provides a positive electrical connection to the tweeter 150 and the second conductive leg 156 provides a negative electrical connection to the tweeter 150.

In accordance with the first exemplary embodiment of the invention, the tweeter 150 contains a diffuser ring 162. The diffuser ring 162 is located on a top face 160 of the tweeter 150, above a tweeter dome 164. Prior use of a diffuser ring 162 has the diffuser ring 162 being mounted directly above a center line/center point of a tweeter dome and causes even radiation of acoustic energy. Prior use of the diffuser ring 162 is described in U.S. Pat. No. 5,689,573, entitled, "FREQUENCY-DEPENDENT AMPLITUDE MODIFICATION DEVICES FOR ACOUSTIC SOURCES", which is hereby incorporated by reference in its entirety.

Unlike prior use of a diffuser ring 162, the present tweeter 150 has the diffuser ring 162 offset from the center line/center point of the tweeter 150. Due to the above-mentioned offset of the diffuser ring 162 from the center line/center point, the radiation pattern shifts/tilts away from the center line/center point of the tweeter dome 164. As an example, looking at the top view provided by FIG. 5A, the diffuser ring 162 is offset so as to be shifted toward a bottom portion of the tweeter 150 top face 160. As a result, the radiation pattern of the tweeter 150 is shifted/tilted toward the bottom portion of the tweeter 150 top face 160.

As is explained further below, the combination of the offset diffuser ring 162 and the angling of the top face of the axis mount faceplate 220, results in tweeter energy being capable of being directed when mounted. As an example, if the audio speaker 100 is located low and forward in a door of a vehicle, the tweeter 150 energy can be directed up and back toward a listener. Directional control of tweeter 150 energy is provided at least by rotation of the axis mount assembly 200.

Figure 6A:
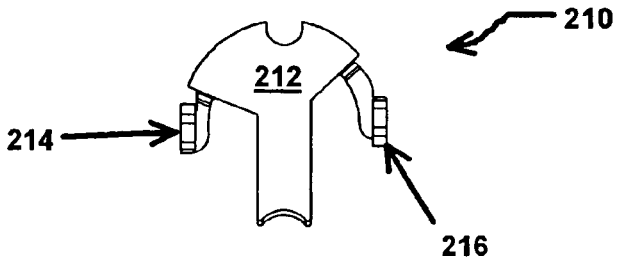
FIG. 6A is a top view of the terminal plate of FIG. 2.
Figure 6B:
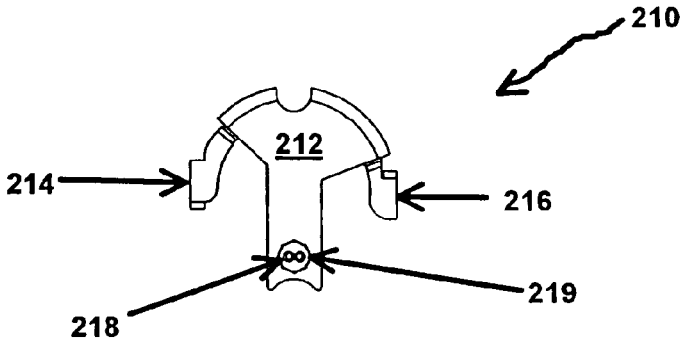
FIG. 6B is a bottom view of the terminal plate of FIG. 2.
Figure 7A:
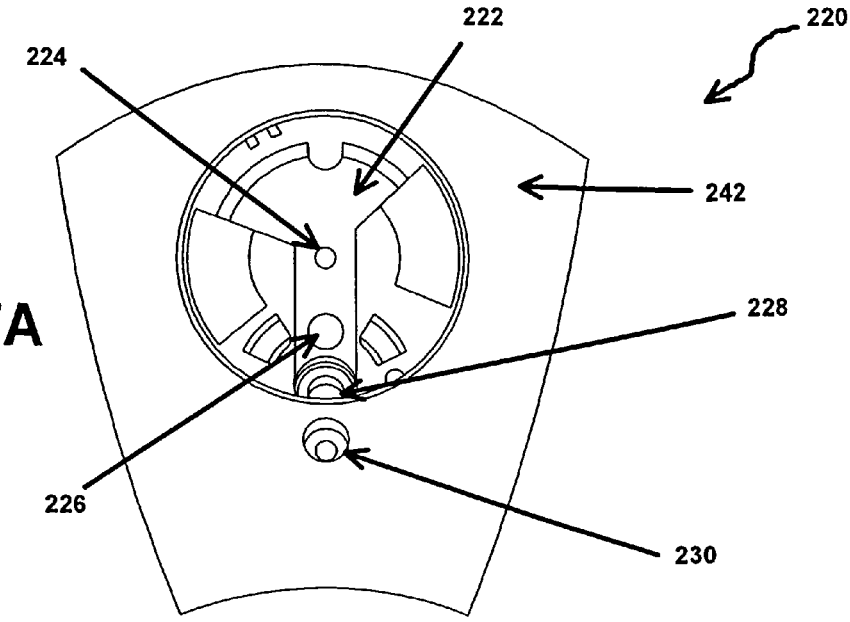
FIG. 7A is a top view of the axis mount faceplate of FIG. 2.
Figure 7B:
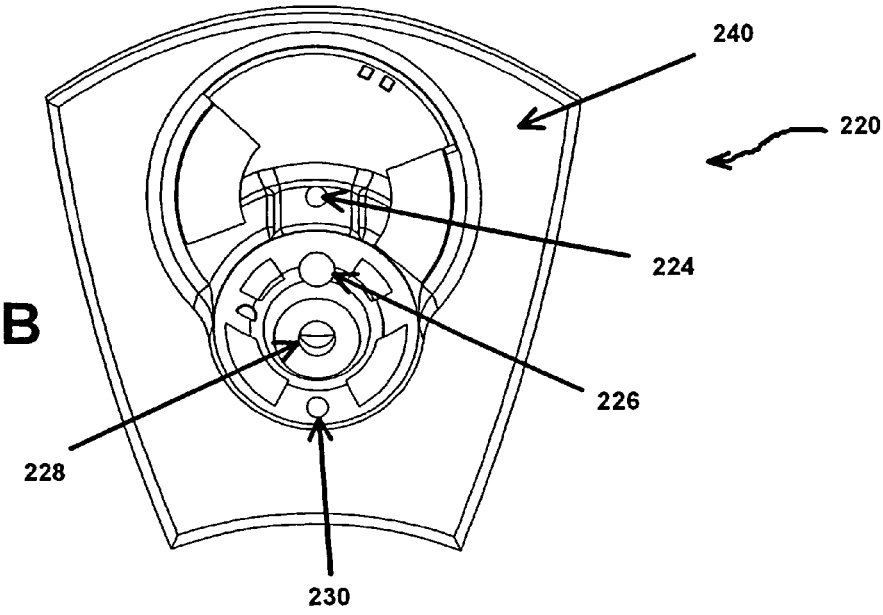
FIG. 7B is a bottom view of the faceplate of FIG. 2.

FIG. 6A is a top view of the terminal plate 210 of FIG. 2, and FIG. 6B is a bottom view of the terminal plate 210 of FIG. 2. Referring to FIG. 6A and FIG. 6B, the terminal plate 210 contains a body 212, a first connection terminal 214, a second connection terminal 216, a first connection wire 218, and a second connection wire 219. The body 212 is shaped so as to allow the body 212 to fit within a shaped central indented portion 222 (FIG. 7A and FIG. 7B) of the axis mount faceplate 220 (FIG. 7A and FIG. 7B). The body 212 is made of a nonconductive material, such as, but not limited to, plastic or ceramic. As an example, the terminal plate 210 made be made of polyvinyl chloride (PVC). The first and second connection terminals 214, 216 are created from conductive material such as, but not limited to, brass or copper. The first and second connection terminals 214, 216 are capable of snap fitting to the bottom portion 152 of the tweeter 150. Specifically, the first connection terminal 214 of the terminal plate 210 connects to the first conductive leg 154 of the tweeter 150 and the second connection terminal 216 of the terminal plate 210 connects to the second conductive leg 156 of the tweeter 150.

A conductive path is provided from the first connection wire 218 of the terminal plate 210 to the second connection terminal 216, and a separate conductive path is provided from the second connection wire 219 of the terminal plate 210 to the first connection terminal 214. Due to conductive paths described herein, when the terminal plate 210 is snap-fitted to the bottom of the tweeter 150, a conductive path is provided from the first connection wire 218 of the terminal plate 210, to the second connection terminal 216 of the terminal plate 210, to the second conductive leg 156 of the tweeter 150. In addition, a conductive path is provided from the second connection wire 219 of the terminal plate 210, to the first connection terminal 214 of the terminal plate 210, to the first conductive leg 154 of the tweeter 150.

It should be noted, that in accordance with an alternative embodiment of the invention, the terminal plate 210 may be connected to the tweeter 150 in a manner other than being snap-fitted, as long as a conductive path is provided to the tweeter 150.

FIG. 7A is a top view of the axis mount faceplate 220 (hereafter, "faceplate") of FIG. 2, and FIG. 7B is a bottom view of the faceplate 220 of FIG. 2. The faceplate 220 is capable of receiving the terminal plate 210 within the central indented portion 222 of the faceplate 220. Specifically, the body 212 of the terminal plate 210 rests within the central indented portion 222 of the faceplate 220, where the central indented portion 222 of the faceplate 220 is shaped to receive the body 212 of the terminal plate 210.

The faceplate 220 contains a first opening 224, a second opening 226, a third opening 228, and a fourth opening 230. The first opening 224 is capable of receiving a bolt that enters from the back 240 of the faceplate 220, through the first opening 224, and into the back opening 158 of the tweeter 150. The second opening 226 is a connection wire opening capable of allowing the first and second connection wires 218, 219 of the terminal plate 210 traverse therethrough. It should be noted that the first and second connection wires 218, 219 of the terminal plate 210 do not connect directly to the faceplate 220, thereby allowing the faceplate 220 to be fabricated from a conductive material. As a result, the faceplate 220 may be fabricated from different materials, including, but not limited to, aluminum, plastic, ceramic, wood or other conductive and/or non-conductive materials.

The third opening 228 is capable of receiving an axle screw 229 (FIG. 1B) that traverses from a top 242 of the faceplate 220, through the third opening 228, through a first opening 252 (FIG. 8A and FIG. 8B) of the axis mount spacer 250, through an opening of the male PCB 260, through an opening of the female PCB 280, and into the phase plug 108 of the audio speaker 100. Specifically, the axle screw 229 is a shoulder screw that is threaded into a threaded hole of the phase plug 108, until positioned therein to prevent removal during rotation. Since shoulder screws are known to those having ordinary skill in the art, further description of the shoulder screw is not provided herein.

The fourth opening 230 is capable of receiving a positioning bolt 244 (FIG. 1B) that traverses through the top of the faceplate 220, through the fourth opening 230, through a second opening 254 (FIG. 8A and FIG. 8B) of the axis mount spacer 250, and into a top portion of the phase plug 108. In accordance with the first exemplary embodiment of the invention, the phase plug 108 has a top positioning opening that is capable of receiving the positioning bolt 244. When the positioning bolt 244 is tightened, the positioning bolt 244 locks the axis mount assembly 200 in a desired position. Specifically, the axis mount assembly 200 is secured from rotation, after the tweeter 150 and axis mount assembly 200 have been properly directed, by tightening the positioning bolt 244, thereby causing an intentional friction lock between the axis mount assembly 200 and the phase plug 108. It should be noted that the tweeter 150 and axis mount assembly 200 are capable of being entirely removed from the audio speaker 100 by removal of the axle screw 229 and loosening of the positioning bolt 244.

In accordance with the first exemplary embodiment of the invention, a plane of the top 242 of the faceplate 220 is not perpendicular to a central axis of the audio speaker 100. Instead, the faceplate 220 is at an angle to the central axis of the audio speaker 100, where the faceplate 220 is angled inward toward the center of the audio speaker 100. The angle of the faceplate 220 maintains the tweeter 150 at an angle, thereby providing for better control of sound projection. As an example, the combination of the faceplate 220 maintaining the tweeter 150 at an angle inward toward the center of the audio speaker 100, and the offset diffuser ring 162, results in the rotation of the tweeter 150 and axis mount assembly 200 controlling sound projection. Therefore, if the audio speaker 100 is located in a factory speaker location of an automobile, namely, in a low and forward position in a door of the vehicle, energy of the audio speaker 100 can be directed up and back toward a listener. This direction is provided by rotation of the tweeter 150 and axis mount assembly 200 within the audio speaker 100.

It should be noted that in accordance with an alternative embodiment of the invention, the plane of the top 242 of the faceplate 220 may be at a different angle to the central axis. Optionally, the faceplate 220 may serve as a heat sink for the tweeter 150, thereby improving overall system handling of the audio speaker 100.

Figure 8A:
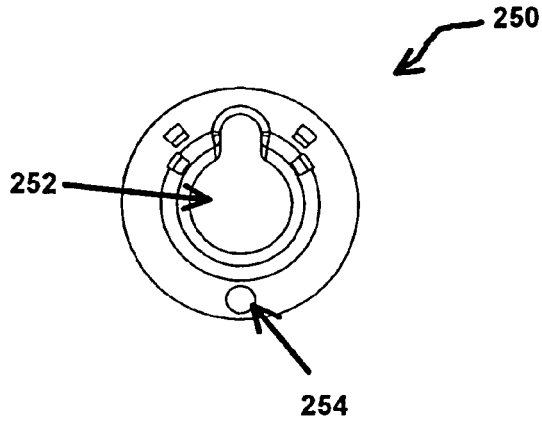
FIG. 8A is a top view of the axis mount spacer of FIG. 2.
Figure 8B:
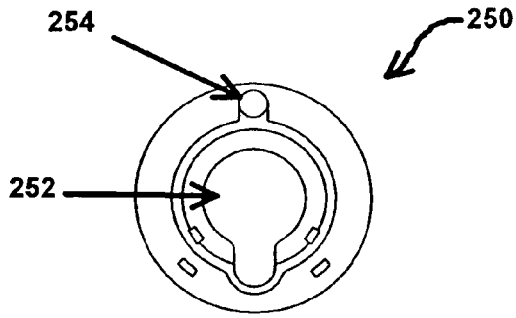
FIG. 8B is a bottom view of the axis mount spacer of FIG. 2.

FIG. 8A is a top view of the axis mount spacer 250 of FIG. 2, and FIG. 8B is a bottom view of the axis mount spacer 250 of FIG. 2. Referring to FIG. 8A and FIG. 8B, the axis mount spacer 250 contains a first opening 252 and a second opening 254. The first opening 252 is capable of allowing the axle screw 229 and the first and second connection wires 218, 219 traverse therethrough. In addition, the second opening 254 is capable of allowing the positioning bolt 224 traverse therethrough. The axis mount spacer 250 also dictates a distance that the tweeter 150 and axis mount assembly 200 extend out from the audio speaker 100. It should be noted that in accordance with alternative embodiments of the invention, the axis mount spacer 250 may be removed from the axis mount assembly 200, or the axis mount spacer 250 may be formed as an extension of the axis mount face plate 220.

Figure 9A:
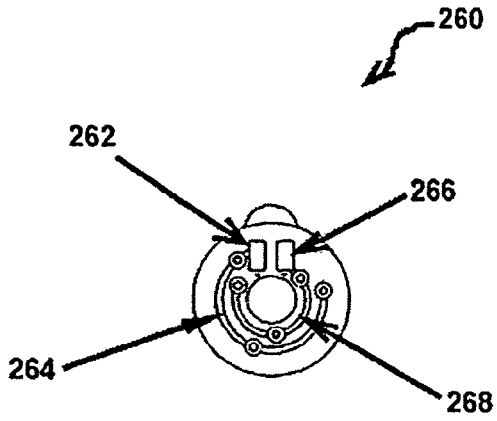
FIG. 9A is a top view of the male PCB of FIG. 2.
Figure 9B:
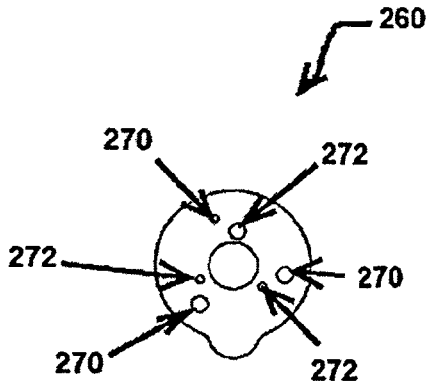
FIG. 9B is a bottom view of the male PCB of FIG. 2.

FIG. 9A is a top view of the male PCB 260 of FIG. 2 and FIG. 9B is a bottom view of the male PCB 260 of FIG. 2. The top portion of the male PCB 260 contains a first conductive pad 262 and a second conductive pad 266. The first conductive pad 262 has a positive polarity and receives the second connection wire 219 of the terminal plate 210. A first conductive path 264 is connected to the first conductive pad 262. The second conductive pad 266 has a negative polarity and receives the first connection wire 218 of the terminal plate 210. A second conductive path 268 is connected to the second conductive pad 266.

The bottom portion of the male PCB 260 contains a first set of conductive pins 270 and a second set of conductive pins 272. The first set of conductive pins 270 are conductively connected to the first conductive path 264, while the second set of conductive pins 272 are conductively connected to the second conductive path 268. As a result, the first set of conductive pins 270 have a positive polarity and the second set of conductive pins 272 have a negative polarity. It should be noted that although the first and second sets of conductive pins 270, 272 are shown to have three conductive pins each, the number of conductive pins may be more or fewer.

Figure 10A:
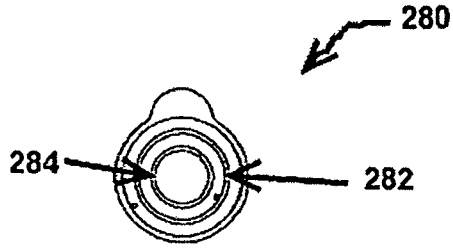
FIG. 10A is a top view of the female PCB of FIG. 2.
Figure 10B:
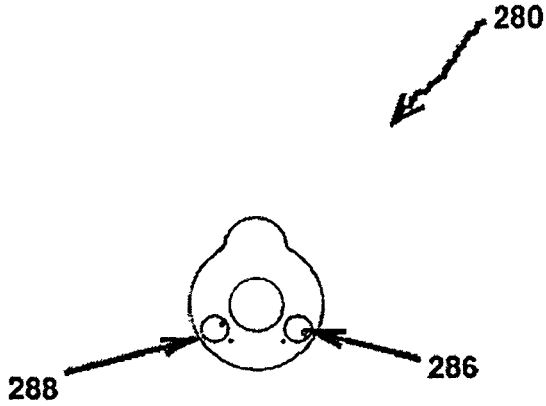
FIG. 10B is a bottom view of the female PCB of FIG. 2.

FIG. 10A is a top view of the female PCB 280 of FIG. 2 and FIG. 10B is a bottom view of the female PCB 280 of FIG. 2. A top portion of the female PCB 280 contains a first concentric trace 282 and a second concentric trace 284. The first concentric trace 282 is capable of receiving the first set of pins 270 and has a positive polarity, while the second concentric trace 284 is capable of receiving the second set of pins 272 and has a negative polarity. The concentric traces 282, 284 are spaced apart so that one concentric trace is located outside of the other. It should be noted, however, that it does not matter which of the two concentric traces 282, 284 is located on the outside or inside.

Referring to a bottom portion of the female PCB 280, the female PCB 280 contains a first conductive contact 286 and a second conductive contact 288, where the first conductive contact 286 has a positive polarity and the second conductive contact 288 has a negative polarity. The conductive strip 290 is connected to the first and second conductive contacts 286, 288, where a positive lead of the conductive strip 290 is connected to the first conductive contact 286 and a negative lead of the conductive strip 290 is connected to the second conductive contact 288.

The conductive strip 290 is flat and flexible, and contains a first conductive path and a second conductive path located between two layers of non-conductive material. As an example, the first and second conductive paths may be flat metal conductors. The positive lead of the conductive strip 290 is connected to the first conductive path within the conductive strip 290 and the negative lead of the conductive strip 290 is connected to the second conductive path within the conductive strip 290.

When the tweeter assembly 120 is assembled on the top of the female PCB 280, the first and second set of pins 270, 272 conductively communicate with the first and second concentric traces 282, 284, respectively. Pressure to push the sets of pins 270, 272 onto the concentric traces 282, 284 may be provided by, for example, a series of springs. As an example, a first set of springs may cause the first set of pins 270 to press against the first concentric trace 282, and a second set of springs may cause the second set of pins 272 to press against the second concentric trace 284. Alternatively, a rubber bumper or other material may be provided for maintaining conductive communication between the pins and traces.

Since conductive communication between the male PCB 260 and the female PCB 280 is maintained by the pin/concentric trace relationship, the axis mount assembly 200, having the tweeter 150 therein, is capable of continuous and infinite variability of rotation and any degree of 360 can be set without binding. It should be noted that, in accordance with an alternative embodiment of the invention, the male PCB 260 and the female PCB 280 may be in opposite locations, where the female PCB 280 is instead a portion of the axis mount assembly 200, and the male PCB 260 is connected to the conductive strip 290. In addition, the pins may be replaced by different conductive members that are capable of maintaining connection to the concentric traces.

The conductive strip 290 may traverse an outer portion of the audio speaker 100 frame 112, to a mounting location (not shown) located on an outer side portion of the frame 112. The mounting location has a positive connection port (not shown) and a negative connection port (not shown).

Figure 11:
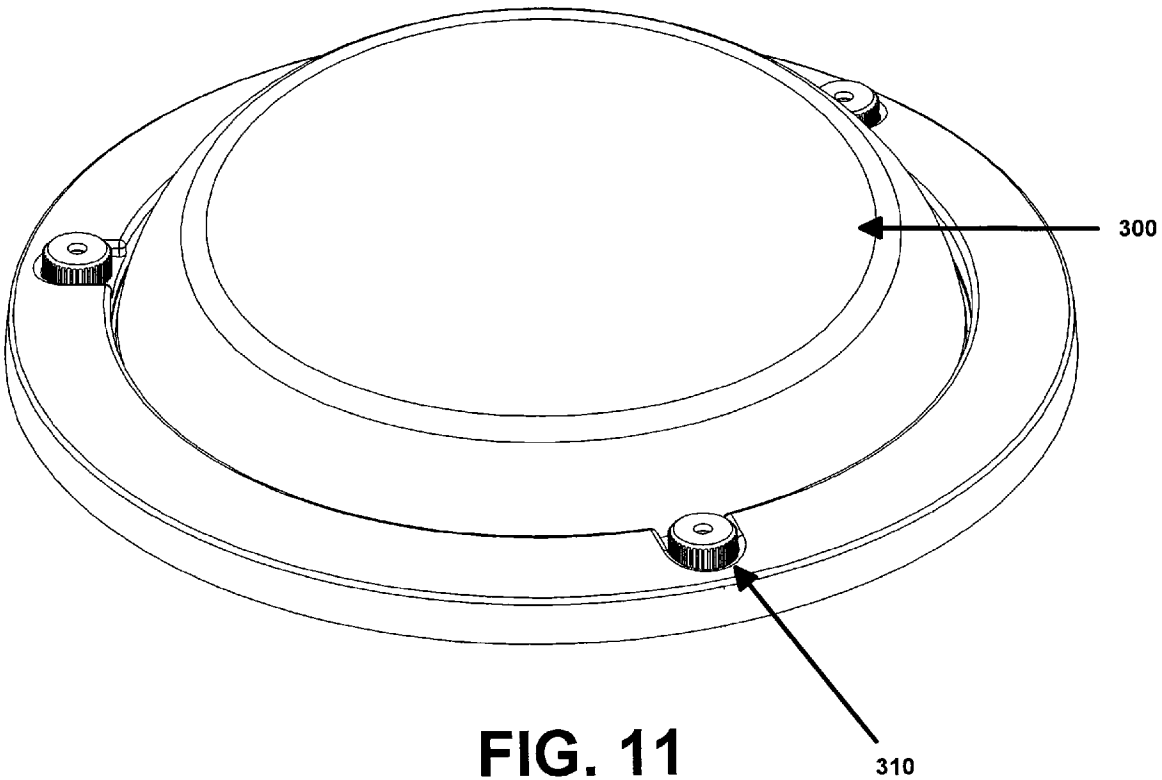
FIG. 11 illustrates a speaker grill connected to the audio speaker of FIG. 1A.

In accordance with an alternative embodiment of the invention, as shown by FIG. 11, a speaker grill 300 may be provided that is capable of being rotated without full disassembly from the audio speaker 100. Locking bolts 310 provide this capability, where optionally, the locking bolts 310 may not allow the speaker grill 300 to be fully removed from the audio speaker 100. The locking bolts 310 are capable of being received by the receiving holes 320 of the audio speaker frame 112.

It should be emphasized that the above-described embodiments of the present invention merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An audio speaker, comprising:

a frame;

a tweeter having a top portion and a bottom portion;

an axis mount assembly, wherein said tweeter is removably connected to said axis mount assembly; and a first connection member, capable of maintaining electrical communication with said axis mount assembly throughout continuous and an infinite number of rotations of said axis mount assembly within said audio speaker.

2. The audio speaker of claim 1, wherein said axis mount assembly further comprises:

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate;

an axis mount spacer located beneath said axis mount face plate; and a second connection member that maintains electrical communication with said first connection member throughout continuous and an infinite number of rotations of said axis mount assembly within said audio speaker.

3. An audio speaker, comprising:

a frame;

a tweeter having a top portion and a bottom portion;

an axis mount assembly, wherein said tweeter is removably connected to said axis mount assembly;

a first connection member, capable of maintaining electrical communication with said axis mount assembly throughout continuous rotation of said axis mount assembly within said audio speaker;

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate;

an axis mount spacer located beneath said axis mount face plate; and a second connection member that maintains electrical communication with said first connection member throughout continuous rotation of said axis mount assembly within said audio speaker;

wherein said first connection member is a male printed circuit board having at least a first pin and a second pin, and wherein said second connection member is a female printed circuit board having at least a first concentric trace and a second concentric trace located on a top portion of said female printed circuit board, wherein each concentric trace is capable of electrically communicating with either said first pin or said second pin.

4. The audio speaker of claim 3, further comprising a conductive strip having a positive lead connected to a first conductive path and a negative lead connected to a second conductive path, said positive lead electrically communicating with either said first or second concentric trace, and said negative lead electrically communicating with the other of said first or second concentric trace.

5. The audio speaker of claim 4, where said conductive strip traverses said audio speaker to a mounting location located on an outer surface of said frame.

6. The audio speaker of claim 2, wherein said terminal plate further comprises:

a first connection terminal;

a second connection terminal, wherein said first and second connection terminals provide said electrical communication between said terminal plate and said tweeter;

a first connection wire in electrical communication with said second connection terminal; and a second connection wire, in electrical communication with said first connection terminal, wherein said first connection wire and said second connection wire electrically communicate with said second connection member.

7. The audio speaker of claim 2, wherein a plane of said top portion of said axis mount faceplate is not perpendicular to a central axis of said audio speaker.

8. An audio speaker, comprising:

a frame;

a tweeter having a top portion and a bottom portion;

an axis mount assembly, wherein said tweeter is removably connected to said axis mount assembly;

a first connection member, capable of maintaining electrical communication with said axis mount assembly throughout continuous rotation of said axis mount assembly within said audio speaker;

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate;

an axis mount spacer located beneath said axis mount face plate;

a second connection member that maintains electrical communication with said first connection member throughout continuous rotation of said axis mount assembly within said audio speaker; and an axle screw that traverses through said axis mount face plate, and ends within said audio speaker, said axle screw being capable of allowing said tweeter and axis mount assembly continuously rotate clockwise and/or counterclockwise within said audio speaker.

9. The audio speaker of claim 8, wherein said audio speaker further comprises a phase plug, and wherein said axle screw ends within said phase plug.

10. The audio speaker of claim 9, wherein said axis mount assembly rests within a top indented portion of said phase plug.

11. The audio speaker of claim 9, wherein said phase plug is a heat sink for said audio speaker.

12. An audio speaker, comprising:

a frame;

a tweeter having a top portion and a bottom portion;

an axis mount assembly, wherein said tweeter is removably connected to said axis mount assembly;

a first connection member, capable of maintaining electrical communication with said axis mount assembly throughout continuous rotation of said axis mount assembly within said audio speaker;

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate;

an axis mount spacer located beneath said axis mount face plate;

a second connection member that maintains electrical communication with said first connection member throughout continuous rotation of said axis mount assembly within said audio speaker; and a positioning bolt that traverses through said axis mount face plate, and being capable of ending within said audio speaker, tightening of said positioning bolt resulting in preventing said axis mount assembly from rotating within said audio speaker.

13. The audio speaker of claim 12, wherein said audio speaker further comprises a phase plug, and wherein said positioning bolt is capable of ending within said phase plug.

14. The audio speaker of claim 1, wherein said top portion of said tweeter further comprises a diffuser ring that is offset from a center point of the tweeter.

15. The audio speaker of claim 1, wherein said tweeter and axis mount assembly are capable of being removed from said audio speaker.

16. The audio speaker of claim 2, wherein said axis mount faceplate is a heat sink for said tweeter.

17. An audio speaker, comprising:

a frame;

a tweeter having a top portion and a bottom portion;

an axis mount assembly, wherein said tweeter is removably connected to said axis mount assembly;

a first connection member, capable of maintaining electrical communication with said axis mount assembly throughout continuous rotation of said axis mount assembly within said audio speaker;

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate;

an axis mount spacer located beneath said axis mount face plate; and a second connection member that maintains electrical communication with said first connection member throughout continuous rotation of said axis mount assembly within said audio speaker;

wherein said second connection member is a male printed circuit board having at least a first pin and a second pin, and wherein said first connection member is a female printed circuit board having at least a first concentric trace and a second concentric trace located on a bottom portion of said female printed circuit board, wherein each concentric trace is capable of electrically communicating with either said first pin or said second pin.

18. The audio speaker of claim 17, further comprising a conductive strip having a positive lead connected to a first conductive path and a negative lead connected to a second conductive path, said positive lead electrically communicating with either said first or second pin, and said negative lead electrically communicating with the other of said first or second pin.

19. The audio speaker of claim 1, further comprising speaker grill capable of removably connecting to said frame of said audio speaker and rotating, said speaker grill comprising locking bolts for securing said speaker grill in a stationary position, where said speaker grill is capable of rotating when said locking bolts are not secure.

20. The audio speaker of claim 2, where said terminal plate is snap-fitted into said bottom portion of said tweeter.

21. The audio speaker of claim 1, wherein said axis mount assembly further comprises:

a terminal plate capable of connecting to said bottom portion of said tweeter, wherein said terminal plate maintains electrical communication with said tweeter;

an axis mount face plate having a top portion and a bottom portion, wherein said axis mount face plate is capable of receiving said terminal plate and tweeter within an indented portion of said top portion of said axis mount face plate; and a second connection member that maintains electrical communication with said first connection member throughout continuous rotation of said axis mount assembly within said audio speaker.

22. An audio speaker, comprising:

a frame;

a tweeter having a top portion and a bottom portion;

means for continuously rotating, wherein said tweeter is removably connected to said means for continuously rotating; and a first connection member, capable of maintaining electrical communication with said means for continuously rotating throughout an infinite number of rotations of said means for continuously rotating within said audio speaker.

* * * * *